US010557651B2

(12) United States Patent
Fan et al.

(10) Patent No.: US 10,557,651 B2
(45) Date of Patent: Feb. 11, 2020

(54) OIL-GAS BALANCING APPARATUS AND COMPRESSOR SYSTEM WITH THE SAME

(71) Applicant: Danfoss (Tianjin) Ltd., Tianjin (CN)

(72) Inventors: Liang Fan, Tianjin (CN); Leping Zhang, Tianjin (CN); Serdar Suindykov, Tianjin (CN)

(73) Assignee: Danfoss (Tianjin) Ltd., Tianjin (CN)

( * ) Notice: Subject to any disclaimer, the term of this patent is extended or adjusted under 35 U.S.C. 154(b) by 257 days.

(21) Appl. No.: 15/295,274

(22) Filed: Oct. 17, 2016

(65) Prior Publication Data

US 2017/0108255 A1 Apr. 20, 2017

(30) Foreign Application Priority Data

Oct. 15, 2015 (CN) ..... 2015 2 0801610 U

(51) Int. Cl.
*F25B 31/00* (2006.01)
*F25B 31/02* (2006.01)
(Continued)

(52) U.S. Cl.
CPC ..... *F25B 31/004* (2013.01); *F01C 21/10* (2013.01); *F04C 18/0215* (2013.01); *F04C 23/00* (2013.01); *F04C 23/001* (2013.01); *F04C 23/008* (2013.01); *F04C 29/02* (2013.01); *F04C 29/021* (2013.01); *F25B 31/026* (2013.01);
(Continued)

(58) Field of Classification Search
CPC ..... F25B 2400/075; F25B 31/004; F25B 31/002; F10M 11/12; F04C 29/021–028; F04C 2240/806; F04C 2240/809; F04C 28/02; F04B 2500/16; F04B 39/0207
See application file for complete search history.

(56) References Cited

U.S. PATENT DOCUMENTS 2,253,623 A * 8/1941 Jordan ..... F25B 31/002 184/103.1
3,140,041 A * 7/1964 Kramer ..... F25B 31/002 417/338
(Continued)

FOREIGN PATENT DOCUMENTS

CN 2530070 Y 1/2003
CN 2670861 Y 1/2005
(Continued)

OTHER PUBLICATIONS

Indian First Examination Report for corresponding India Application No. 201614035358 dated Apr. 29, 2019.

*Primary Examiner* — Keith M Raymond
(74) *Attorney, Agent, or Firm* — McCormick, Paulding & Huber PLLC

(57) ABSTRACT

An oil-gas balancing apparatus includes: a body, a gas balancing opening and at least one oil balancing hole. The body has a first end and a second end opposite to the first end, and the first end can be fixedly connected to a shell of a compressor and in communication with an oil sump of the compressor and a chamber of the oil sump. The gas balancing opening is disposed on a first portion of an end surface of the second end. The at least one oil balancing hole is disposed on a second portion of the end surface of the second end. The second portion and the first portion are oppositely disposed. A compressor system can include the oil-gas balancing apparatus.

17 Claims, 3 Drawing Sheets

(51) Int. Cl.

| | |
|---|---|
| ***F04C 29/02*** | (2006.01) |
| ***F01C 21/10*** | (2006.01) |
| ***F04C 23/00*** | (2006.01) |
| ***F04C 18/02*** | (2006.01) |

(52) U.S. Cl.
CPC .... *F04C 18/0207* (2013.01); *F04C 2240/806* (2013.01); *F04C 2240/809* (2013.01); *F04C 2270/70* (2013.01); *F25B 2400/075* (2013.01)

(56) References Cited

U.S. PATENT DOCUMENTS

| | | | | |
|---|---|---|---|---|
| 3,386,262 | A * | 6/1968 | Hackbart | F25B 1/00 62/469 |
| 3,581,519 | A * | 6/1971 | Garrett, Jr. | F25B 31/002 417/228 |
| 6,453,691 | B1 | 9/2002 | Seo et al. | |
| 9,051,934 | B2 * | 6/2015 | Fraser | F04C 29/021 |
| 9,273,678 | B2 | 3/2016 | Bonnefoi et al. | |
| 2013/0330210 | A1 * | 12/2013 | Bonnefoi | F04C 23/001 417/62 |
| 2015/0044070 | A1 | 2/2015 | Zhang et al. | |

FOREIGN PATENT DOCUMENTS

| | | | |
|---|---|---|---|
| CN | 101676564 | A | 3/2010 |
| CN | 201740315 | U | 2/2011 |
| CN | 103486768 | A | 1/2014 |
| CN | 204678732 | U | 9/2015 |
| JP | 2002195626 | A | 7/2002 |

* cited by examiner

OIL-GAS BALANCING APPARATUS AND COMPRESSOR SYSTEM WITH THE SAME

CROSS REFERENCE TO RELATED APPLICATION

Applicant hereby claims foreign priority benefits under U.S.C. § 119 from Chinese Patent Application No. 201520801610.1 filed on Oct. 15, 2015, the content of which is incorporated by reference herein.

TECHNICAL FIELD OF THE INVENTION

The present invention relates to the field of cooling technologies, and in particular, to an oil-gas balancing apparatus and a compressor system using same.

BACKGROUND OF THE INVENTION

A refrigeration system may need multiple compressors in some situation. For example, a parallel connection technology for compressors is used more and more widely in the air conditioning and refrigeration industry. Compressors connected in parallel have advantages, such as convenience in energy adjustment, convenience in maintenance when a single compressor is down, and low costs. Normally, lubricating oil is indispensable while a compressor is running. However, the compressors may have different capacities and different pipe designs, and as a result, a certain compressor, especially, a scroll compressor with a low-pressure chamber may be damaged due to lack of lubricating oil. Therefore, oil levels of the compressors need be controlled. In current oil level control, an active oil-return apparatus widely used in the refrigeration industry may be used, but it has high costs and a complicated system structure, is not applicable to commercial and light commercial air conditioning. It is also possible to adjust the pipe designs to implement oil level control, but this manner cannot reliably control the oil levels of the compressors. Therefore, the current oil level control has higher costs and lower reliability.

SUMMARY OF THE INVENTION

An objective of the present invention is to solve at least one of the foregoing problems and defects in the prior art.

According to embodiments, an oil-gas balancing apparatus and a compressor system using the same are provided, which can effectively balance gas pressure between compressors connected in parallel, balance oil levels between the compressors, and can effectively avoid an excessively low oil level of a compressor.

According to an aspect, an oil-gas balancing apparatus applicable to a compressor includes: a body, wherein the body includes a first end and a second end opposite to the first end, and the first end is able to be fixedly connected to a shell of a compressor and be in communication with an oil sump of the compressor and a chamber of the oil sump; a gas balancing opening, wherein the gas balancing opening is disposed on a first portion of an end surface of the second end; and at least one oil balancing hole, wherein the at least one oil balancing hole is disposed on a second portion of the end surface of the second end, and the second portion and the first portion are oppositely disposed.

In an example, when the oil-gas balancing apparatus is assembled to the shell of the compressor, the gas balancing opening is set to be above the oil balancing hole, the gas balancing opening is in communication with the chamber of the oil sump of the compressor, and the oil balancing hole is in communication with the oil sump of the compressor.

In an example, the gas balancing opening extends from the end surface of the second end to an end surface of the first end, and the oil balancing hole extends from the end surface of the second end to the end surface of the first end.

In an example, the oil-gas balancing apparatus is in a cylindrical shape in nature, and the gas balancing opening is in a semicircular or rectangular shape.

In an example, the end surface of the second end is a circular end surface;

the first portion of the end surface of the second end is a semicircle in which the gas balancing opening is located, and the second portion of the end surface of the second end is another semicircle in which the oil balancing hole is located.

In an example, there is one oil balancing hole, and the oil balancing hole is symmetrically disposed along a vertical diameter of the circular end surface; and the gas balancing opening is symmetrically disposed along a vertical diameter of the circular end surface.

In an example, a diameter of the oil balancing hole ranges from 1 mm to 5 mm.

In an example, the first end of the body includes a first connection portion and is configured to be connected to the compressor via the first connection portion by means of threads or welding.

In an example, the second end of the body comprises a second connection portion and is configured to be connected to at least one another compressor via the second connection portion through a pipe.

In an example, the second end of the body comprises a second connection portion and the second connection portion is provided with a sight glass or a nut.

According to another aspect, a compressor system includes at least two compressors disposed in parallel; the two compressors are a first compressor and a second compressor, and the first compressor is provided with a first oil-gas balancing apparatus described above, and the oil-gas balancing apparatus is in communication with the second compressor through a pipe.

In an example, the second compressor is provided with a second oil-gas balancing apparatus described above, and the first oil-gas balancing apparatus of the first compressor is connected to the second oil-gas balancing apparatus of the second compressor through a pipe.

BRIEF DESCRIPTION OF THE DRAWINGS

To make these and/or other aspects and advantages of the present invention clearer and more comprehensible, embodiments with reference to the accompanying drawings will be described.

DETAILED DESCRIPTION OF THE INVENTION

The technical solutions of the present invention will be described in detail by embodiments with reference to FIG.

Figure 4:
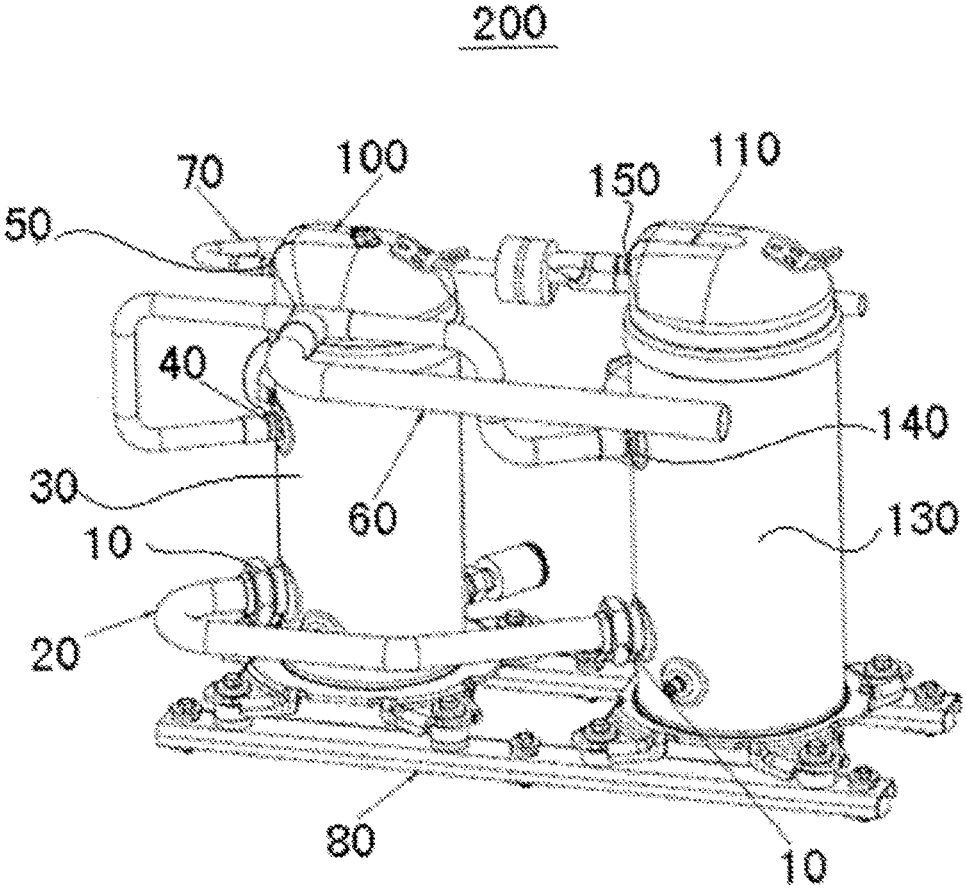
FIG. 4 is a schematic diagram of a compressor system where compressors are connected in parallel by using the oil-gas balancing apparatus shown in FIG. 1.

1 to FIG. 4. In this description, same or similar reference signs in the accompanying drawings indicate same or similar components. The following description on implementation manners of the present invention with reference to the accompanying drawings is to illustrate a general invention idea of the present invention, and should not be understood as a limitation to the present invention.

A conventional refrigeration system is widely used in an air conditioning apparatus for cooling and heating room air, and some other refrigeration machines. A compressor system in the conventional refrigeration system may include multiple compressors. One of the compressors is a main compressor, and may be a compressor whose capacity is adjustable (or whose output volume is changeable), or may be a fixed-capacity compressor. To enable the refrigeration system to work in a part-load mode, the compressor system may further include multiple secondary compressors connected in parallel. These secondary compressors may intermittently work according to a load requirement. When a relatively precise capacity is required, the main compressor may be the compressor whose capacity is adjustable (or whose output volume is changeable). Specifically, in the conventional refrigeration system, there are several methods to balance lubricating oil between the main compressor and the secondary compressors. For example, a method for balancing oil between multiple compressors is to use an oil balancing pipe between the compressors. Another method is to use an oil separator on a gas discharge path. However, those methods cannot achieve reliable oil balancing in a part load condition. If there is an oil balancing pipe, a compressor having a small output volume may easily be lack of oil. If the refrigeration system has no oil balancing pipe, a compressor having a large output volume may, more quickly, become oil-starved.

The conventional compressor system is generally configured with an oil balancing pipe. The oil balancing pipe is connected in parallel or in series to oil sumps of the compressors. In some solutions, a gas balancing pipe may be installed between the compressors, in order to reduce a pressure difference between different compressor shells, where the pressure difference may be caused by different refrigerant flows.

However, if both the gas balancing pipe and the oil balancing pipe are used, a gas balancing opening and an oil balancing opening need be designed for a compressor, which increases design costs. During assembly, a leakage risk is increased due to more welding interfaces; besides, pipe costs will also be higher.

If only the oil balancing pipe is used, the pressure difference between the compressors' chambers may not be balanced, thereby leading to imbalance between oil levels in the compressors.

Figure 1:
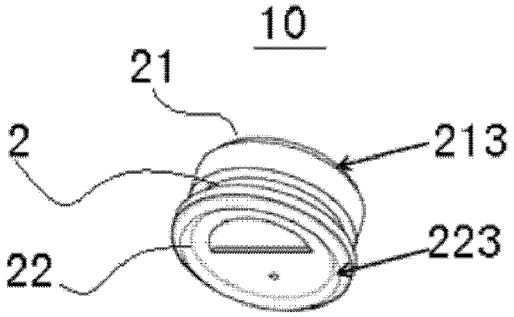
FIG. 1 is a 3-D view of an oil-gas balancing apparatus according to an embodiment of the present invention.
Figure 2:
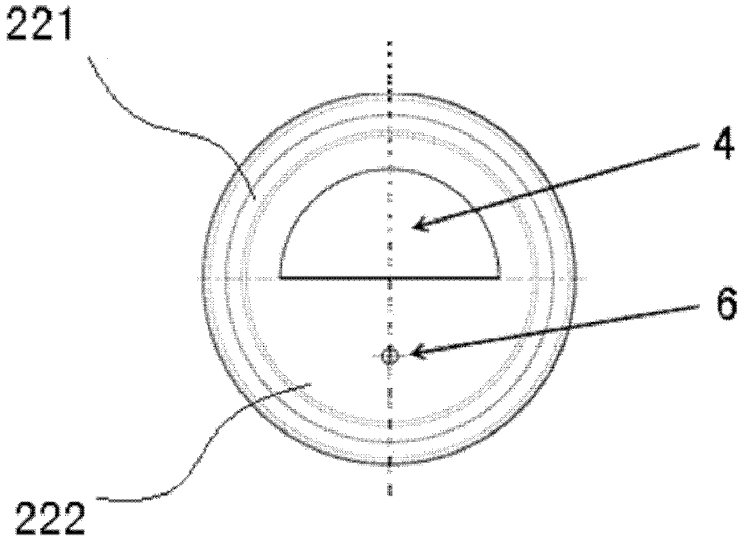
FIG. 2 is a view of an end surface of the oil-gas balancing apparatus shown in FIG. 1.
Figure 3:
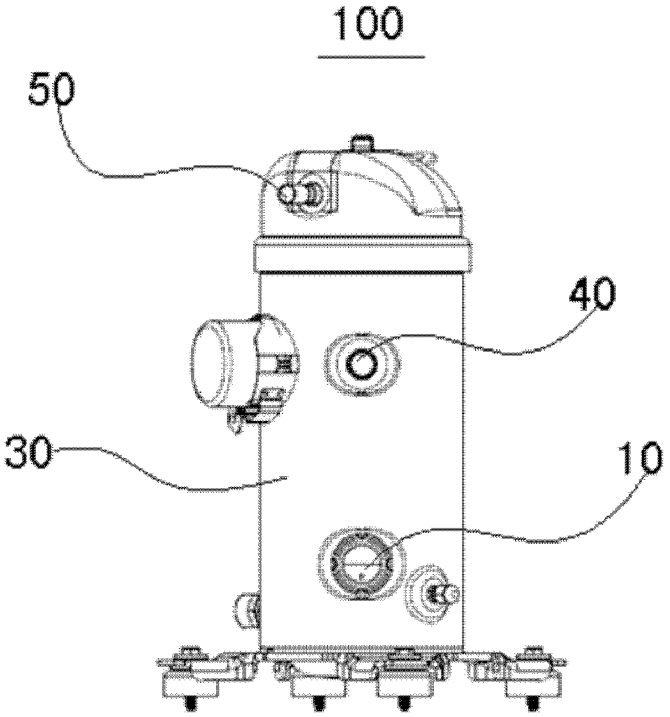
FIG. 3 is a schematic diagram of a compressor using the oil-gas balancing apparatus shown in FIG. 1.

As shown in FIG. 1 and FIG. 2, an embodiment of the present invention provides an oil-gas balancing apparatus 10 applied to a compressor. The oil-gas balancing apparatus 10 includes: a body 2, a gas balancing opening 4, and at least one oil balancing hole 6. The body 2 has a first end 21 and a second end 22 opposite to the first end 21. With reference to FIG. 3 and FIG. 4, the first end 21 may be connected to a shell 30 of a compressor or a shell 130 of a compressor) and be in communication with oil sumps of the compressors (which are not shown in the figure and are disposed at bottoms of the compressors). An end surface of the second end 22 is a circular end surface. A first portion 221 of the end surface of the second end 22 is a semicircle in which the gas balancing opening 4 is located, and a second portion 222 of the end surface of the second end 22 is the other semicircle in which the oil balancing hole 6 is located. The gas balancing opening 4 is configured in the first portion 221 of the end surface of the second end 22 of the body 2. The at least one oil balancing hole 6 is configured in the second portion 222 of the end surface of the second end 22 of the body 2. The second portion 222 and the first portion 221 are oppositely disposed.

In an example, there is one oil balancing hole 6, and the oil balancing hole 6 is symmetrically disposed along a vertical diameter of the circular end surface, and the gas balancing opening 4 is symmetrically disposed along a vertical diameter of the circular end surface.

With reference to FIG. 3 and FIG. 4, when the oil-gas balancing apparatus 10 is assembled to the shell of the compressor, the gas balancing opening 4 is configure to be above the oil balancing hole 6. The oil-gas balancing apparatus 10 is assembled with its a position direction shown in FIG. 2 on the shell 30 or 130. When the oil-gas balancing apparatus 10 is assembled on the compressor, the gas balancing opening 4 is configured to be on an upper part of the oil-gas balancing apparatus 10, operable for balancing gas pressure within a chamber in an oil sump of the compressor. That is, the gas balancing opening 4 and the oil balancing hole 6 in the oil-gas balancing apparatus 10 are respectively in communication with the chamber in the oil sump and the oil sump itself, thereby ensuring gas pressure balance between chambers of oil sumps of the compressors and oil balance between the oil sumps of the compressors.

It can be understood that, the gas balancing opening 4 extends from the end surface of the second end 22 to the end surface of the first end 21. Alternatively, the gas balancing opening 4 extends from the second end 22 to the first end 21, so as to be in communication with the chamber of the oil sump of the compressor.

The gas balancing opening 4 may be in a semicircular shape, a rectangular shape, or any other suitable shape, as long as the gas balancing opening 4 can balance the gas pressure in the chamber of the compressor. As shown in FIG. 1 and FIG. 2, the oil-gas balancing apparatus 10 is in a cylindrical shape in nature. The gas balancing opening 4 is semicircular. In an example, the semicircle of the gas balancing opening 4 and a circle of the end surface of the second end 22 may share a same circle center, and a radius of the semicircle of the gas balancing opening 4 is shorter than a radius of the circle of the end surface of the second end 22. The first portion 221 of the end surface is a semicircle (a semicircle in FIG. 2) in which the gas balancing opening 4 is located. The second portion 222 of the end surface is the other semicircle (a lower semicircle in FIG. 2) in which the oil balancing hole 6 is located. The gas balancing opening 4 in a semicircular shape can make full use of an area of the end surface and can ensure a pressure-bearing capacity of the oil-gas balancing apparatus 10.

It may be understood that the oil balancing hole 6 also extends from the end surface of the second end 22 to the end surface of the first end 21, in order to implement oil balancing control. The number of oil balancing holes 6 may be configured on demand. For example, FIG. 2 shows one oil balancing hole 6. A diameter of the oil balancing hole 6 is within a range of 1 mm to 5 mm. The oil balancing hole 6 may be below the circle center of the end surface of the second end 22, as shown in a dotted line in FIG. 2.

The first end 21 of the body 2 is provided with the first connection portion 213, configured to be connected to the shell 30 or 130 by means of threads or welding.

A second connection portion 223 disposed on the second end 22 of the body 2 is connected to at least one compressor by using a pipe 20 (referring to FIG. 4). The second connection portion 223 may be connected to the pipe 20 by means of threads or welding.

FIG. 3 shows a compressor 100 assembled with the foregoing oil-gas balancing apparatus 10. The compressor 100 includes a shell 30, a gas inlet 40, and a gas outlet 50. Certainly, the compressor 100 may further include an orbiting and a fixed scroll, a crankshaft structure, etc. However, these structures will not be described in detail herein.

The oil-gas balancing apparatus 10 may be disposed on the shell 30 of the compressor 100 as an independent component, and is assembled into the compressor 100. An end of the oil-gas balancing apparatus 10 (the second end 22) may be further provided with a sight glass or a nut (which is not shown in drawings). The sight glass is configured to observe an oil level of an oil sump at the bottom of the compressor 100. The nut is configured to seal the second end 22 of the oil-gas balancing apparatus 10.

FIG. 4 is a schematic diagram of a compressor system where compressors are connected in parallel by using an oil-gas balancing apparatus shown in FIG. 1. The compressor system 200 includes a first compressor 100 and a second compressor 110. It may be understood that, the compressor system 200 may include multiple compressors connected in parallel to each other, but not limited to the two compressors shown in FIG. 4. However, only two compressors connected in parallel will be used as an example for description.

The first compressor 100 includes a shell 30, a gas inlet 40, a gas outlet 50, and an oil-gas balancing apparatus 10 assembled on the shell 30 (a specific position is the lower part of the shell 30). Similarly, the second compressor 110 includes a shell 130, a gas inlet 140, a gas outlet 150, and an oil-gas balancing apparatus 10 assembled on the shell 130 (a specific position is the lower part of the shell 130). The oil-gas balancing apparatus 10 of the first compressor 100 is in communication with the oil-gas balancing apparatus 10 of the second compressor 110 by using a pipe 20. It may be understood that, a person skilled in the art may configure the pipe 20 based on requirements. For example, the pipe 20 may be a pipe having two passages integrated within one pipe. Specifically, the two passages are respectively and correspondingly in communication with an gas balancing opening 4 and an oil balancing hole 6. In another example, the pipe 20 may also be a pipe having one passage inside. The pipe 20 may be a bronze pipe or a pipe made of any other suitable materials.

The gas inlet 40 of the first compressor 100 and the gas inlet 140 of the second compressor 110 are in communication with each other by using a pipe 60. In addition, the gas outlet 50 of the first compressor 100 and the gas outlet 150 of the second compressor 110 are in communication with each other by using another pipe 70.

Preferably, a fixing structure 80 (shown in FIG. 4) may be used to fix the first compressor 100 and the second compressor 110 connected in parallel.

Two or more compressors may be connected in parallel by using oil-gas balancing apparatuses 10, and gas balancing openings 4 in the oil-gas balancing apparatuses 10 are configured to ensure gas pressure balance between chambers of oil sumps in the compressors, and oil balancing holes 6 in the oil-gas balancing apparatuses 10 are configured to balance oil levels and avoid an excessively low oil level of a certain compressor.

Alternatively, a person skilled in the art may design whether all compressors connected in parallel use the oil-gas balancing apparatus 10 in the present invention, or whether some of compressors connected in parallel are provided with the oil-gas balancing apparatus 10. For example, in FIG. 4, only the first compressor 100 uses the oil-gas balancing apparatus 10, but the second compressor 110 does not use the oil-gas balancing apparatus 10.

The compressor system 200 described above may be applied to a refrigeration air conditioner or an air compression system.

The above descriptions are merely some embodiments of the present invention. A person of ordinary skill in the art should understand that, changes may be made to the embodiments without departing from the principle and spirits of the general invention idea. A scope of the present invention is defined by claims and equivalents of the claims.

What is claimed is:

1. An oil-gas balancing apparatus applicable to a compressor, comprising:

a body, wherein the body is in a cylindrical shape in nature and comprises a first end and a second end opposite to the first end, and the first end is configured to be fixedly connected to an outside surface of a shell of a compressor and be in communication with an oil sump of the compressor and a chamber of the oil sump, the second end has a circular flat end surface and is configured to be connected to an oil balancing pipe of the compressor;

a gas balancing opening, wherein the gas balancing opening is disposed on a first portion of the circular flat end surface of the second end and extends from the circular flat end surface of the second end to an end surface of the first end; and at least one oil balancing hole, wherein the at least one oil balancing hole is disposed on a second portion of the circular flat end surface of the second end and extends from the circular flat end surface of the second end to the end surface of the first end, and the second portion and the first portion are oppositely disposed;

wherein the body is configured to extend between the shell of the compressor and the oil balancing pipe; and wherein the gas balancing opening and the oil balancing opening are separate and distinct from each other.

2. The oil-gas balancing apparatus of claim 1, wherein in response to assemble the oil-gas balancing apparatus to the shell of the compressor, the gas balancing opening is set to be above the oil balancing hole, the gas balancing opening is in communication with the chamber of the oil sump of the compressor, and the oil balancing hole is in communication with the oil sump of the compressor.

3. The oil-gas balancing apparatus of claim 1, wherein the gas balancing opening is in a semicircular shape.

4. The oil-gas balancing apparatus of claim 3, wherein the first portion of the end surface of the second end is a semicircle in which the gas balancing opening is located, and the second portion of the end surface of the second end is another semicircle in which the oil balancing hole is located.

5. The oil-gas balancing apparatus of claim 4, wherein there is one oil balancing hole, and the oil balancing hole is symmetrically disposed along a vertical diameter of the circular end surface; and the gas balancing opening is symmetrically disposed along a vertical diameter of the circular end surface.

6. The oil-gas balancing apparatus of claim 1, wherein a diameter of the oil balancing hole ranges from 1 mm to 5 mm.

7. The oil-gas balancing apparatus of claim 1, wherein the first end of the body comprises a first connection portion and is configured to be connected to the compressor via the first connection portion by threads or welding.

8. The oil-gas balancing apparatus of claim 1, wherein the second end of the body comprises a second connection portion and is configured to be connected to at least another compressor via the second connection portion through the oil balancing pipe.

9. A compressor system, wherein the compressor system comprises at least two compressors in parallel; and the at least two compressors are a first compressor and a second compressor;

wherein the first compressor is provided with a first oil-gas balancing apparatus recited in claim 1, and the first oil-gas balancing apparatus is in communication with the second compressor through a pipe.

10. The compressor system of claim 9, wherein the second compressor is provided with a second oil-gas balancing apparatus recited in claim 1, and the first oil-gas balancing apparatus of the first compressor is connected to the second oil-gas balancing apparatus of the second compressor through the pipe.

11. The oil-gas balancing apparatus of claim 2, wherein the second end of the body comprises a second connection portion and is configured to be connected to at least another compressor via the second connection portion through the oil balancing pipe.

12. The oil-gas balancing apparatus of claim 3, wherein the second end of the body comprises a second connection portion and is configured to be connected to at least another compressor via the second connection portion through the oil balancing pipe.

13. The oil-gas balancing apparatus of claim 4, wherein the second end of the body comprises a second connection portion and is configured to be connected to at least another compressor via the second connection portion through the oil balancing pipe.

14. The oil-gas balancing apparatus of claim 5, wherein the second end of the body comprises a second connection portion and is configured to be connected to at least another compressor via the second connection portion through the oil balancing pipe.

15. The oil-gas balancing apparatus of claim 6, wherein the second end of the body comprises a second connection portion and is configured to be connected to at least another compressor via the second connection portion through the oil balancing pipe.

16. The oil-gas balancing apparatus of claim 7, wherein the second end of the body comprises a second connection portion and is configured to be connected to at least another compressor via the second connection portion through the oil balancing pipe.

17. The oil-gas balancing apparatus of claim 2, wherein the second end of the body comprises a second connection portion and the second connection portion is provided with a sight glass or a nut.

* * * * *